United States Patent [19]

Simon

[11] Patent Number: 4,526,474

[45] Date of Patent: Jul. 2, 1985

[54] DEVICE FOR STORING AND DISPENSING DRUG DOSES

[76] Inventor: Udo Simon, Ziegelsteinstrasse 212, D-8500 Nürnberg 10, Fed. Rep. of Germany

[21] Appl. No.: 622,099

[22] Filed: Jun. 19, 1984

[30] Foreign Application Priority Data

Jun. 25, 1983 [DE] Fed. Rep. of Germany ..... 3322920
Sep. 29, 1983 [DE] Fed. Rep. of Germany ..... 3335301

[51] Int. Cl.[3] ..... G04B 47/00

[52] U.S. Cl. ..... 368/10; 368/109; 368/107; 206/534; 116/308

[58] Field of Search ..... 368/10, 107, 109, 89; 206/534; 116/308

[56] References Cited

U.S. PATENT DOCUMENTS 4,158,411 6/1979 Hall et al. ..... 206/534
4,223,801 9/1980 Carlson ..... 221/3
4,258,354 3/1981 Carmon et al. ..... 368/10
4,382,688 5/1983 Machamer ..... 368/10
4,419,016 12/1983 Zoltan ..... 368/10
4,448,541 5/1984 Wirtschafter ..... 368/10
4,483,626 11/1984 Noble ..... 368/10

*Primary Examiner*—Bernard Roskoski
*Attorney, Agent, or Firm*—Collard, Roe & Galgano

[57] ABSTRACT

A device is described for storing, and periodically announcing the time for removal of, drug doses in pill, tablet or capsule form. A patient is warned at regular intervals to remove a drug dose from a blister pack serving as drug container.

An electronic timer system associated with the blister pack activates periodically a signal emitter which emits a preferably acoustic signal. Optionally an optical signal emitter can also be installed in the warning ystem. The system comprises an electrically activatable input which receives a starting pulse at the time when a first drug dose is to be removed from the blister pack. The starting pulse is generated by rupturing, through removal of a drug dose from a blister pocket, an electric pulse lead which extends across the blister pocket in the rupturable closing foil of the latter and which is connected to the starting pulse input of the timer in the warning system.

33 Claims, 7 Drawing Figures

Fig. 6A
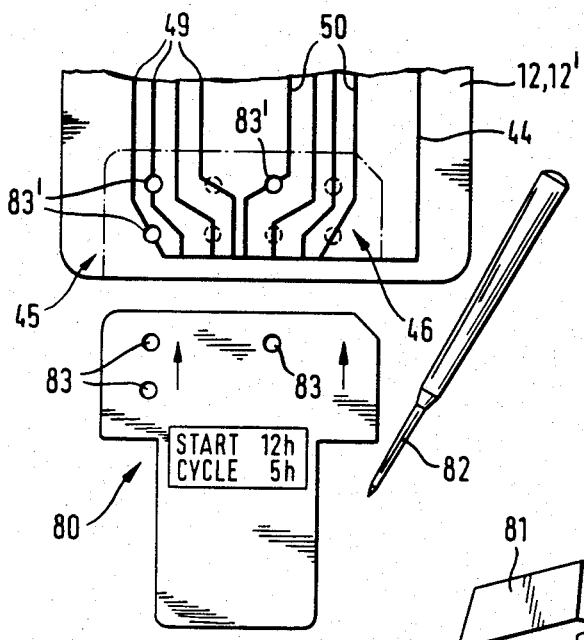
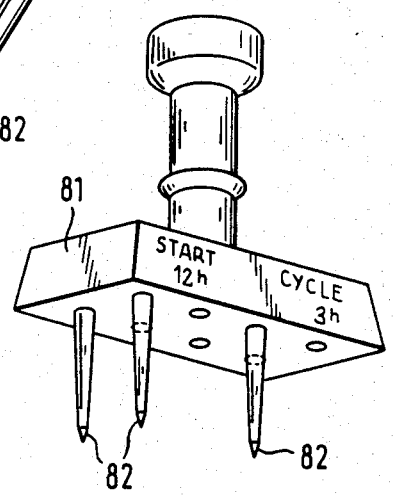
Fig. 6B

DEVICE FOR STORING AND DISPENSING DRUG DOSES

BACKGROUND OF THE INVENTION

This invention relates to a device for storing and dispensing drug doses, and more particularly a device for the storage and the periodical dispensing of a drug, comprising a drug container, an electronic timer system, associated with the drug container, and comprising a signal emitter emitting acoustic and/or optical signals and being activated, at adjustable time intervals, and starting pulse input means connected with the signal emitter and being adapted for electric activation and for feeding of an electric starting pulse thereinto. The drug body contains means comprising a first foil containing a series of blister pockets arranged in at least one row and adapted for each of the pockets receiving a drug dose body therein, and at least one backing foil closing off the pockets and adapted for being ruptured in a rupturable foil area opposite each of the pockets, upon pressure being exercized in the area of a drug dose body on that side, of the first foil, from which the blister pockets project.

It is frequently required that a patient take certain doses of pharmaceutical drugs periodically in certain intervals. Thus it is often of utmost importance for the life of a patient that he regularly receives an effective dose of insulin. Also, heart medications must be applied at regular intervals. The same is true for contraceptive pills which must be taken in a regular daily cycle if they are to offer effective protection to a female patient.

Certain groups of patients, such as adolescents or old people often lack the necessary conscientiousness or memory which causes them to overlook or forget the points in time when they should take the drug doses.

In the German Offenlegungsschrift No. 3,204,770 there has been described a container for pills, tablets or the like, which has essentially the shape of a flat circular lidded box the base part of which can be rotated vis-à-vis the lid provided with a dispensing opening. In this container there is built in a timer devised as a microprocessor and equipped with a programmable signalling device which is activated dependent on the rotary movements which must be carried out in order to remove a pill. Such a device can be designed to remind the patient or taker of the pill that is is time to do so.

In the German Offenlegungsschrift No. 2,921,520, a control device is described which consists essentially of a stationarily operable alarm clock, for instance a clock radio, which controls, by means of an auxiliary device, the removal of pills from a blister pack.

A "sensing" of the blister pack is carried out electronically by causing light from a light source through the chambers of the foil pack, destined for containing the pills, to a photosensitive element, whereby it is possible to register the number of pills having been removed, and/or to activate an alarm emitter connected with the alarm clock. In practice, this known device can only be operated when stationary, it is complicated and expensive, and will fail when foil packs of opaque material are being used.

OBJECTS AND SUMMARY OF THE INVENTION

It is an object of the invention to provide a portable compact device for storing drugs and for periodically remminding a patient insistently when it is time to take the next dose of the drug. It is another object of the invention to provide a device of the above-described type in which the signal emitter, present therein and being activatable at adjustable time intervals, is directly connected with the removal of drug doses from a drug container therefor.

These objects and others that will become apparent from the following description of the invention are attained, in accordance with the invention, by a device of the initially described kind in which at least one electric pulse lead extending across each of the rupturable areas of the at least one second foil and being connected with the pulse input means and being connected with the starting pulse input means of the timer system, the said electric pulse lead being rupturable together with the rupturable foil area;

the signal emitter and electric pulse lead being so arranged as to introduce an electric pulse from the lead via the said starting pulse input means into the signal emitter at least at the first time rupturing of the electric pulse lead.

Thereby, it becomes possible, for the first time, to detect by simple means the removal of a drug dose such as a pill, tablet, capsule or the like, from a foil pack, the signal emitter being activated only when the drug dose is pressed through the rupturable foil of the pack. it is thus not possible to re-activate the signal emitter or reset it in "new start" position, for instance, by opening the drug container and reclosing it.

In the case of particularly valuable pharmaceutical drugs the timer system can be an integral part of the drug container, and the device can further comprise electric building units such as an integrated electric circuit, being supported directly on the second foil.

Preferably, especially when cheap drugs are involved, the device comprises separable connecting means for connecting the electric timer system detachably with the drug container, and care must be taken to provide a safe electric contact between the lead sections on the foil and the signal emitter where the latter is connected with the drug container. The electric pulse lead can be integrated in the second foil. When the pack only contains tablets of equal effective and equal duration of effect, then a common pulse lead for all tablets can be sufficient, and branch leads can extend via several up to all of the blisters of the drug container.

When tablets of different activity and in particular of different duration of effect, which must be taken at different intervals, the drug container must then comprise blisters filled with drug dose bodies of at least two types of drugs of different strength and different effective duration, and the electronic timer system comprises a corresponding number of at least two memory registers and the same corresponding number of starting pulse input means, and a corresponding electric pulse lead, each of the blisters being connected via a pulse lead with the corresponding pulse input means pertaining to the respective type of drug present in each blister.

In this embodiment, the timer system preferably comprises a time-indicating means adapted for indicating the contents of that respective memory register which has been activated and recalled. It is thus possible to activate even complicated, different timing sequences, one after the other and to make it much easier for a patient to take the different medicines.

Furthermore, the timer system can comprise setting means for the input of register contents and a lockable cover for the setting means, so that third persons cannot alter the setting. Moreover, the timer can comprise setting means and setting pulse input means associated therewith, and the setting pulse entry means can be adapted for being shut off after programming, manually or automatically, for instance 5 minutes after re-calling the first setting pulse input. In this way, only a physician or a pharmacist can set the dispensing times of a memory circuit, and the contents stored in the memory can be protected against tampering by unauthorized persons.

By providing electronic pulse leads which extend across rupturable areas of the second or underside foil of a pack in undulating or zig-zag configuration or the like, the breaking of the lead is assured whenever a drug dose is squeezed out of its blister pocket. Undulating or zig-zag configurations are meant to comprise all other configurations such as U-shapes, meandering, spiral-shape and the like shape of the lead or wire in the rupturable area below the blister pocket containing a drug dose.

Experience has shown that the underside foil will rupture along the rim of the blister pocket in the shape of a moon sickle. Whenever the "zigzag" configuration of the lead or wire traverses these rim zones, the desired rupturing of the lead will be achieved without fail when a drug dose (pill, tablet etc.) is removed from its blister.

According to another inventive feature the setting means can comprise interruptable setting pulse leads (wire, printed line, etc.) and the setting pulse input means are adaptable for being activated via the last-mentioned leads which are applied on the second foil of the drug container so as to correspond with the electric pulse leads. This applies the concept of interrupting pulse leads to the interruption of setting pulse inputs. When the setting pulse inputs are provided with manually or automatically rupturable setting pulse lines or leads and can be thus activated, then a pharmacist or physician can effect a desired initial activation, for instance with the aid of a sharp pointer or punch or the like, and can thus fix the first time alert for the patient's taking a drug dose and then initiate the drug intake cycle or cycles, in which the patient is periodically reminded by the device of the point in time for the next drug intake.

To this end, two different kinds of setting pulse inputs are provided by that the timer system comprises first setting pulse input means adapted for the input of a first drug dose consumption time, and second setting pulse input means adapted for the input of the time period for a drug consumption cycle.

Even a layman can effect the programming without error, when, according to another feature of the invention the setting pulse input means are in a pre-determined arrangement, and the timer system further comprises a perforated template adapted for being placed on the second foil in a preset position marked thereon, the template being adapted for covering the arrangement of setting pulse input means in such a manner that, when the template is in the said preset position on the second foil, only those setting pulse input means which are destined to be ruptured, are uncovered because they register with a perforation in the template and can thus be ruptured individually.

The template is marked in accordance with the time interval to be entered into the program (for instance a cycle of 3 hours for a patient's taking of a drug dose), while only those setting pulse inputs can be interrupted, due to the specific arrangement of the holes in the template, which are to be interrupted for the respective time interval.

Interruption is effected by means of a pointed tool inserted in the holes of the template, and in an even simpler manner by a programming punch and perforating pins protruding from one face of the punch, which perforating pins are disposed in a pin arrangement corresponding to the location of certain pre-selected setting pulse inputs in the pre-determined input simultaneously rupturing only the certain setting pulse inputs. The other setting pulse inputs remain intact. It is essential that markings are provided on the foil which permit an exact positioning of the template thereon and thus an exact guide for the punching step.

In preferred embodiments, the timer system comprises as a building unit, an integrated electrical circuit and an electronic sensor circuit, which sensor circuit is connected with the electric pulse leads on the input side, and is preferably adapted for acting as a differentiator. The sensor circuit comprises, for each electric pulse lead present, two flip-flops connected in series and constituting a two-bit shifting register, and two exclusive-OR gates, each of which gates is connected on the output side to a different one of the said flip-flops, the output of each gate being connected with a starting pulse input means of the integrated electrical circuit.

This sensor electronics circuit senses the change of state caused by rupturing the pulse lead. By common impulsing of the two-bit shifting register the old output information stored in the input-connected flip-flop (input of the intact pulse lead connected to ground wire) is shifted through to the input of the subsequent, output-connected flip-flop which then in turn represents the old state. Simultaneously, the new input information is read into the input side-connected flip-flop (input "High" as it is pulled up with the aid of a "Pull-up" electric current source). The two flip-flops are in different states to which the output-connected exclusive-OR gate will respond, and put through logically and emit a starting pulse.

In the case of several two-bit shifting registers being provided which are to be read out concurrently with each other, then the parallel output informations of the exclusive-OR gates must be connected by means of a simple OR gate. The feature of the states of the electric pulse leads being checked only during timely separated short call pulses, in order to save electric energy, has the advantage of requiring only very small voltage sources. The call up of the lead states requires only short calling times which may optimally last only a few microseconds and which can be switched at minute-long intervals. Such resolution of time is, as a rule, completely sufficient for taking a medicine.

When, according to a further feature of the invention, the timer system comprises first setting pulse input means, and calling of the electric pulse leads takes place after the activation of at least one of the first setting pulse input means, then the, for instance, one-minute long calling cycles of the pulse leads are turned on only after the activation of the first setting pulse inputs, thus achieving a further saving of energy. It is only necessary to control the setting pulse inputs, for which control a minimum portion of the available energy of a battery is sufficient. Thereby the lifetime of the required batteries is approximated to the length of the life of the drugs involved, so that the device according to the invention can be employed for almost any kind of drug and can be stored by a pharmaceutical producer, a pharmacist or a physician, without any damage caused by the said device.

According to yet another preferred feature of the invention, the timer system can comprise a common starting pulse lead, as well as, connected in parallel with each section of an electric pulse lead extending across a blister pocket, a separate resistor, and an analog-digital converter type circuit adapted for determining the changes in total resistance, which converter type circuit has an input to which the common starting pulse lead is connected.

It is thus possible to control a very large number of blister pockets with a far smaller number of inputs. In principle, with each pulse lead section which extends across a drug dose pocket, there is connected in parallel a resistor which has been deposited on the foil preferably by thick layer-depositing method. At the input side the digital ohm-meter preferably consisting of an analog/digital converter responds to the change of resistance which occurs whenever a pulse lead section is ruptured by emitting a starting pulse. This is particularly the case when each of the resistors in such a resistor chain has a different resistance value, and the dispensing interval period depends on the amount of resistance increase occurring when the corresponding electric pulse lead suction, connected with the respective resistor is ruptured.

The digital ohm-meter is thus enabled to select resistance changes of different magnitudes and, independent of the size of such resistance change, to select differently stored times as drug-taking intervals. Thereby, it is possible to indicate with this novel type of device even complicated drug-taking cycles involving a plurality of different drug-taking times, practically without danger of confusion.

Furthermore, in still another embodiment of the device according to the invention, the timer system comprises a plurality of starting pulse inputs adapted for being recalled by at least one analog/digital converter, and, connected with each of the starting pulse inputs, a resistor chain, each of which starting pulse inputs also are connected with a section of the electric pulse lead extending across a blister pocket. More in particular, the timer system can comprise an integrated electric circuit and a second signal emitter connected with the output side of the integrated electric circuit. This second signal emitter can be adapted for emitting optical signals. The acoustic signal emitter can comprise a piezoelectric loudspeaker, adapted for emitting differently modulated sound signals, or sounds of different frequencies.

The provision of a further signal source not only enables information to be given to a patient that it is time to take a further pill, but also to inform him which of the number of different kinds of pills present in a pack must be taken. The additional signal source can be devised as a red light-emitting diode which indicates clearly to the patient that he must take one of the red-colored drugs present in the mixed pack. When the additional signal emitter does not light up, this indicates that, when the signal of the main signal source is emitted, a dose of the other drug tablets, of a color other than red, must be taken.

Such a device can, for instance, be particularly useful when, for instance, the cycle of taking the same drug in the daytime differs from the cycle to be observed at nighttime. In order not to strain the battery of the device unduly it can be advantageous to activate the photo diode by pressing a button - as is customary in the case of an electronic quartz watch. Thus, a patient can first be reminded by an acoustic signal that it is time to take a new tablet or the like drug dose, and he then presses a button on the device to find out which kind of tablet he must remove from the pack.

It is also within the scope of the invention to use photo diodes of different colors, or a diode which can be activated in two different colors. Advantageously the drug container bears the same colors, thus making it almost impossible to mix up the tablets.

Thus, the device according to the invention can also be equipped with a timer system comprising an additional optical indicating means which is adapted for being activated automatically after a pre-selected period of time, whenever, after activation of the signal emitter, no tablet or the like drug dose body has been dispensed from the drug container; or, the additional optical indicating means can be connected in series at the outlet side of the signal emitter and can be automatically activated whenever the signal emitter is activated after a periodically reoccurring period of time.

BRIEF DESCRIPTION OF THE DRAWINGS

Further objects and advantageous features of the invention will become apparent from the further description thereof in connection with the accompanying drawings in which FIGS. 6A, 6B are a schematic represenation of a perforated template placed on a foil and a stemple therefor.

DETAILED DESCRIPTION OF THE EMBODIMENT SHOWN IN THE DRAWINGS

Figure 1:
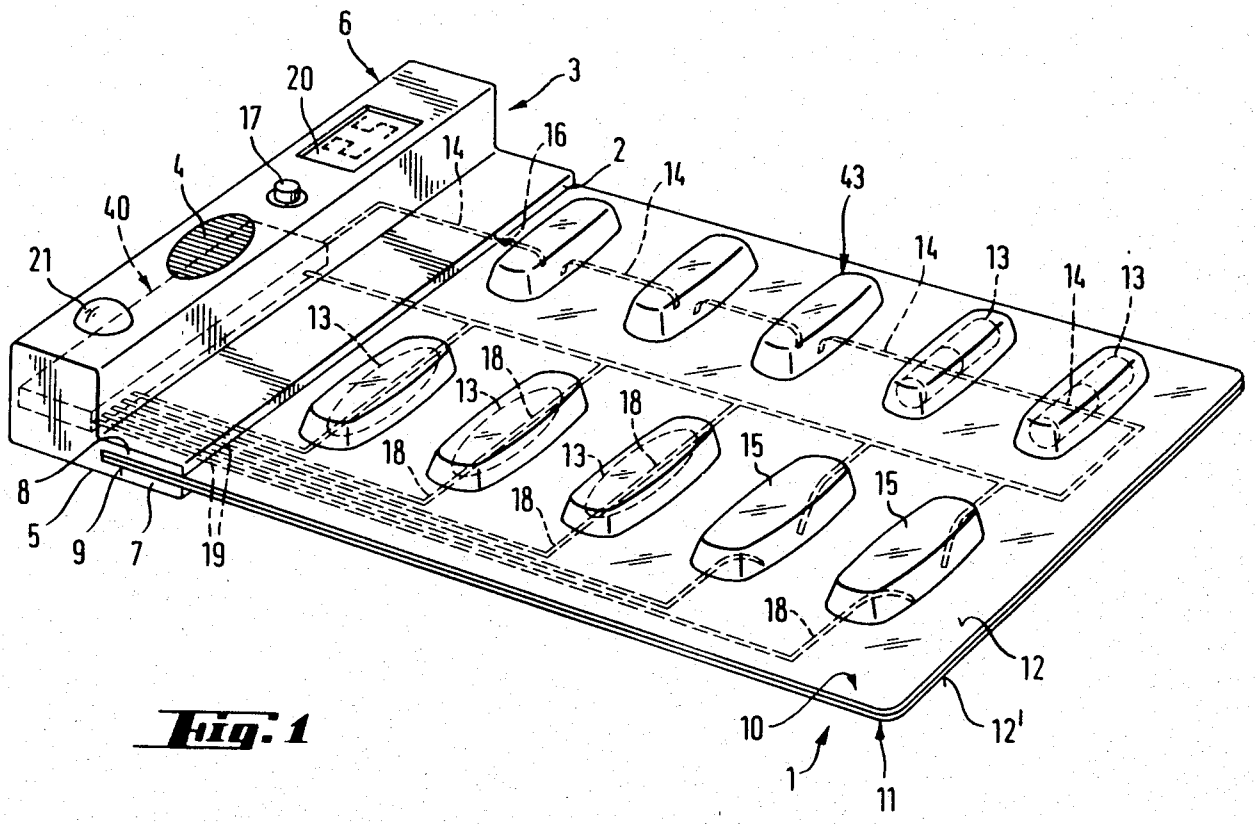
FIG. 1 shows in perspective schematical representation a preferred embodiment of the drug storing and dispensing device according to the invention, consisting of a drug container and an attached electric timer system with signal emitter.

The embodiment of a drug-storing and dispensing device according to the invention comprises a drug container 1 at one lateral side 2 of which there is attached an electric timer system comprising the signal emitter 3, consisting essentially of a signal sound emitter 4 being a chirping or squeaking loudspeaker and/or an optical signal emitter 21.

The detachable connection between the drug container, which comprises two foils glued together, and the signal emitter 3 is a snap-in connection 5 which provides two holding lips 7 and 8 being integral with the casing 6 of the signal emitter 3. Between these lips 7 and 8 there is a gap 9 into which the marginal foil portion at the edge 2 can be inserted, the lips 7 and 8 exerting pressure on the two surfaces 10 of the upper foil 12 and on the underside 11 of the lower foil 12', respectively, thus guaranteeing a sufficiently secure connection.

In order to start emission of a signal at the exact time when a drug dose body 13, e.g. a pill, tablet or capsule, is to be removed from the drug container 1, there is provided an electric pulse lead 14 which extends across the blister pockets 15 containing the drug bodies 13. When pressing with a finger on a blister wall of the foil 12 and the drug body therein, the latter is urged through the rupturable second foil 12' serving to close the open underside of the blister pocket, whereby the portion of foil 12' below the body 13 is torn open and the lead 14 is broken. Thereby, a voltage change will occur at the starting pulse input 16 to which the pulse lead 14 is connected. This voltage change activates the electronic timer system and reminds the patient to take the next drug dose, after a pre-set period of time has elapsed which is put into the timer system via a time setting unit 17.

On the right hand side of the drug container 1 illustrated in FIG. 1, as seen from the timer system-bearing end thereof there is provided in a different lead arrangement, together with a common pulse lead 14', a number of further pulse leads 18 each of which leads across only one blister pocket 15, respectively, and each of which is connected with a starting pulse input 19. The electronic connection between the pulse leads 14 (14'), 18 and the starting pulse inputs 16, 19 can be effected by means of spring contact means which are arranged in the receiving gap or slot 9. Such spring contact means are well known to be used for making contact between contactor plates.

The signal emitter 3 is provided with a digital time-indicating means 20 which indicates the time still to elapse before the next-following drug dose must be taken.

Figure 2:
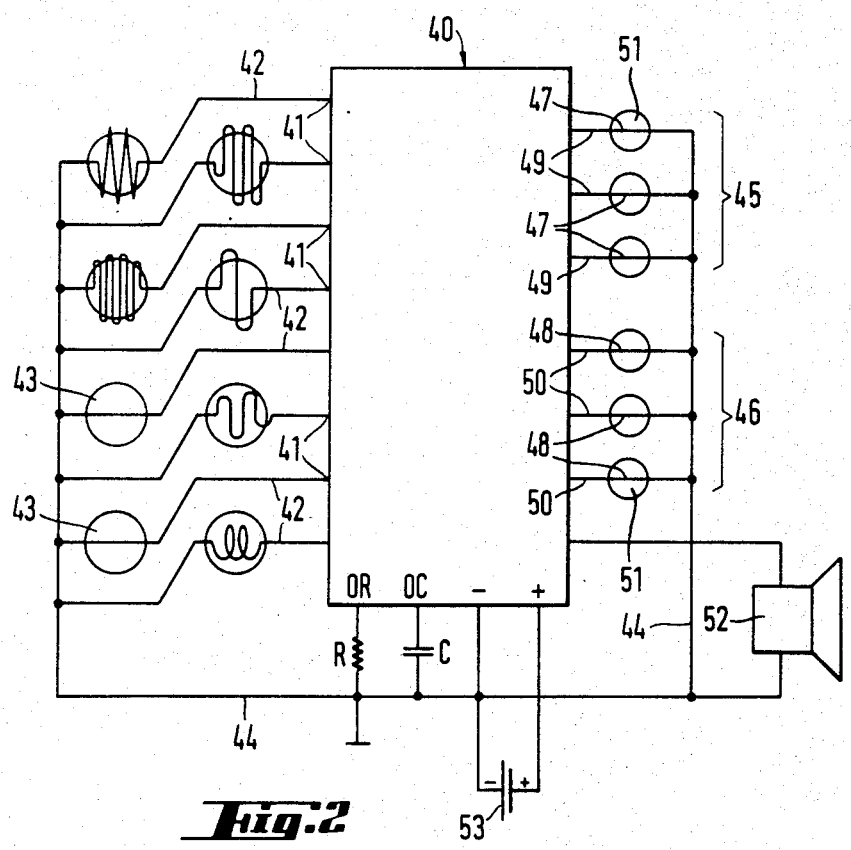
FIG. 2 shows a basic circuit diagram with integrated circuit.

The circuit diagram shown, by way of example in FIG. 2 shows, as signal emitter, an integrated circuit 40 whose starting or trigger pulse inputs 41 are connected with eight trigger pulse leads 42. These are shown to extend across the blister pockets 43 in several different embodiments in FIG. 2, for instance in zig-zag or undulating or the like configurations and are then connected with a common ground wire 44.

On the right hand side of the integrated circuit 40; there are provided two groups of setting pulse inputs 45 and 46, the first group of which inputs 45 serves for the input of the first time to take a drug dose, for instance when the patient is to take the first drug dose (pill) after 24 hours have elapsed; the second group of inputs 46 serves for the input of at least one cycle or period of time, i.e., the patient, after taking the first pill, is to take a further pill each time after a period of 12 hours has elapsed.

In order to serve the setting pulse input groups 45 and 46 there are also provided rupturable sections 47 and 48 in the setting pulse leads 49 and 50. These sections 47 and 48 can be easily ruptured with the aid of a pin. As long as they are intact, the setting pulse leads are connected with the ground wire 44 in the same manner as are the trigger pulse leads 42. When due to an ruptured section 47 or 48, the connection is interrupted, then the respective input is activated.

As a time base 64, there is provided in FIG. 2 an R-C unit which can, however, be replaced by a quartz crystal of the type used in clocks. A piezoelectric loudspeakers is designated by reference numeral 52 and represents a signal source, while as voltage source there is provided a battery 53.

Figure 3:
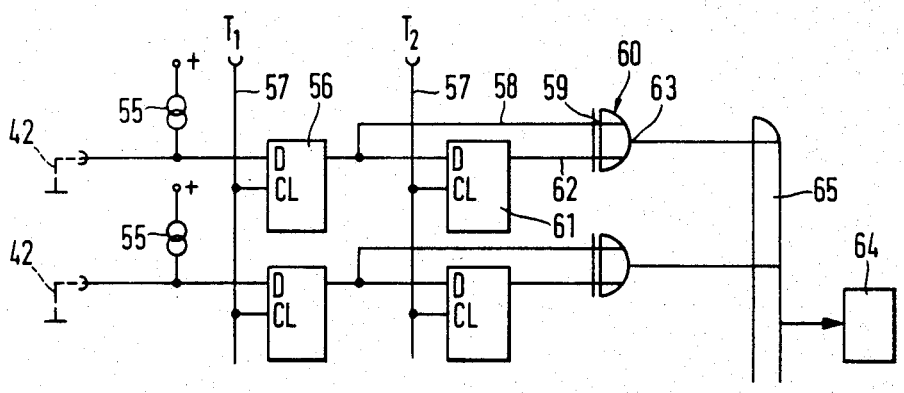
FIG. 3 shows a basic circuit diagram of the electronic sensor.

The basic circuit diagram shown in FIG. 3 illustrates that electronic unit which is connected to the outputs following inputs 41 and which is provided for deducting changes of state in the pulse leads 42 which are indicated by dashed lines. Each input is provided with a pull-up current source 55 which supplies electric current to the D-input of an output-connected first flip-flop 56, when the connection of the input with the ground wire 44 is interrupted, and which reads into the flip-flop 56, whenever a timing pulse occurs in the timing pulse lead 57, so that its output line 58 reflects the new state "pulse lead ruptured" and passes it on to the first input 59 of an exclusive-OR gate 60. As, however, the old state information ("pulse lead intact") still prevails in a flip-flop 61 which is output-connected with the first flip-flop 56, the output 62 of the second flip-flop 61 still reflects the old state, so that the output lines 58 and 62 have different potentials. The output of the exclusive-OR gate 60 then extends the trigger signal through to the output-connected time base. When there are provided several trigger pulse leads 42—as is the case in FIG. 3—then there are also required several two-bit shifting registers each consisting of two flip-flops 56, 61 the states of which must be compared via separate exclusive-OR gates 63 and must be collectd in an output-connected common OR-gate 65.

Figure 4:
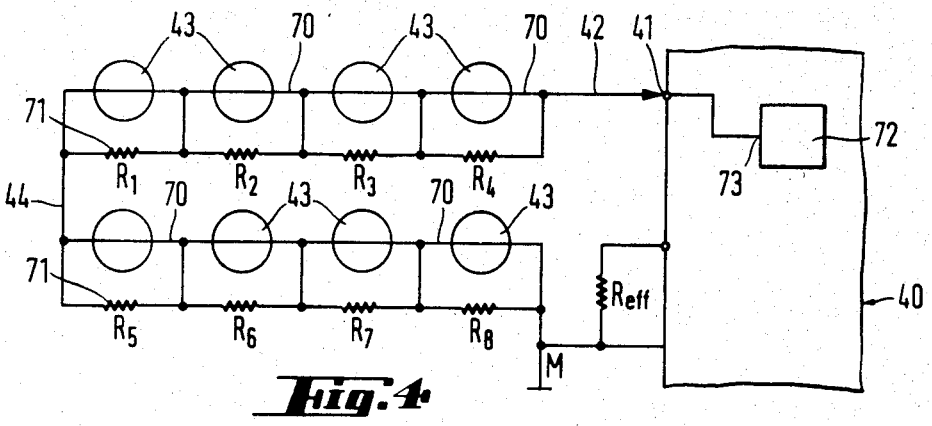
FIG. 4 shows a basic circuit diagram with a resistor chain.

The embodiment shown in FIG. 4 is concerned with a switching variant which permits saving of trigger pulse inputs. To this end, there are provided resistors 71, each of which is connected in parallel with a different pulse line section 70 extending across a blister pocket 43. To the output side from the starting pulse input 41 there is connected an analog/digital converter 72 which will send a trigger pulse to the output-connected time base whenever a change of resistance occurs in the input-connected trigger pulse line.

Now, when one of the pulse line sections 70, which are connected in series with each other, is ruptured, then an increase of resistance corresponding to the ohm value of the respective resistor 71 will occur at the input 41.

Figure 5:
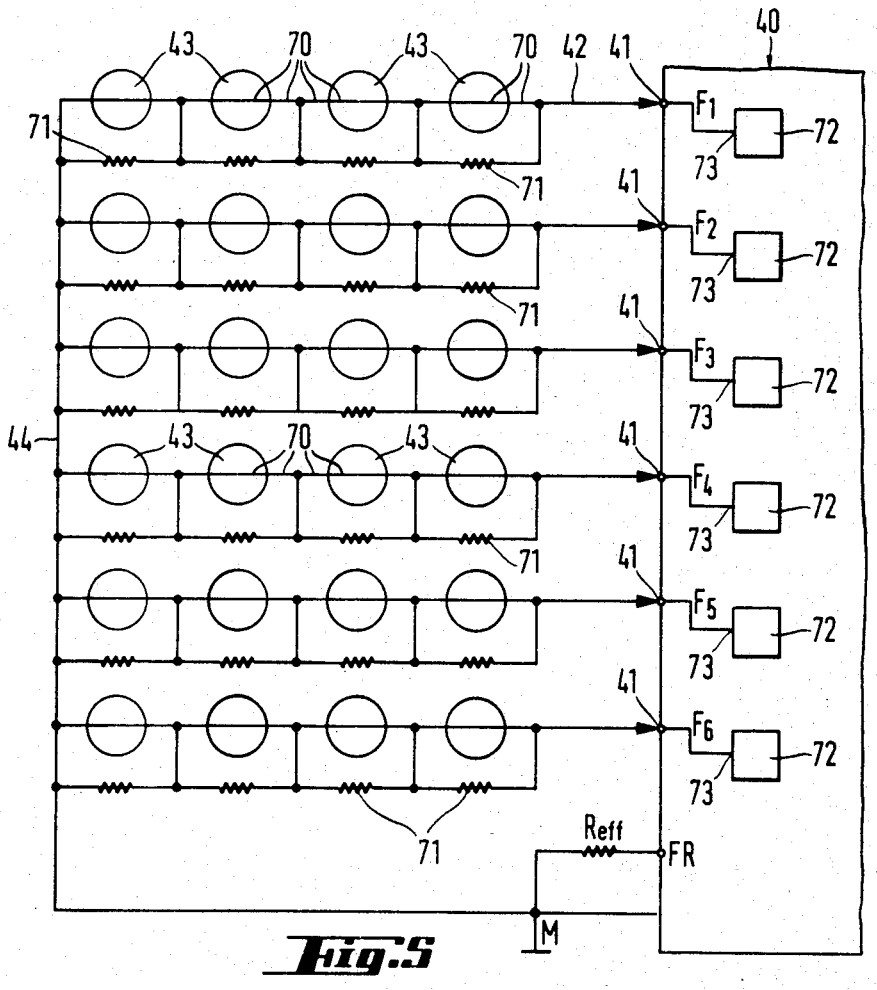
FIG. 5 shows a basic circuit diagram with several starting pulse inputs connected to resistor chains.

When the resistors 71 have different ohm-values and the analog/digital converter 72 is adapted for applying the different changes of resistance for triggering different time intervals, then, on the basis of the circuit diagram shown in FIG. 5, there is provided a device which is capable of informing a patient, in a pre-set programming sequence, of different cycles of taking different doses of different drugs.

In FIG. 6 there is shown a perforated template 80 which is placed on the foil 12 in the region of setting pulse inputs 45, 46 and only leaves accessible those setting pulse inputs which must be ruptured (holes 83) in order to set certain pre-selected periods of time which can be printed on the device.

A programming punch designated by 81 bears on its underside perforating pins 82 for rupturing the pre-selected setting pulse inputs 45, 46 which are arranged distanced from one another in an exact pattern. Optionally, the template and the programming punch can bear distinctive color designs which can be noted down by a physician in his prescription. The pharmacist is thereby enabled to apply the correct programming of the drug container solely by being guided by the color design indicated on the template and/or the punch.

I claim:

1. A device for the storage and the periodical dispensing of a drug, comprising a drug container, an electronic timer system, associated with said drug container, and comprising a signal emitter being activated, at adjustable time intervals, and starting pulse input means connected with said signal emitter and being adapted for electric activation and for feeding of an electric starting pulse thereinto, said drug dose body containing means comprising a first foil containing a series of blister pockets arranged in at least one row and adapted for each of said pockets receiving a drug dose body therein, and at least one backing foil closing off said pockets and adapted for being ruptured in a rupturable foil area opposite each of said pockets, upon pressure being exercized in the area of a drug dose body on that side, of said first foil, from which said blister pockets project, at least one electric pulse lead extending across each of said rupturable areas of said at least one second foil and being connected with said pulse input means and being connected with said starting pulse input means of said timer system, said electric pulse lead being rupturable together with said rupturable foil area;

said signal emitter and electric pulse lead being so arranged as to introduce an electric pulse from said lead via said starting pulse input means into said signal emitter at least at the first time rupturing of said electric pulse lead.

2. The device of claim 1, wherein said signal emitter is adapted for emitting an acoustic signal.

3. The device of claim 1, wherein said signal emitter is an optical signal.

4. The device of claim 1, wherein said timer system is an integral part of said drug container, and wherein said device further comprises electric building units being supported directly on said second foil.

5. The device of claim 4, wherein said electric building units comprise an integrated electric circuit.

6. The device of claim 1, further comprising separable connecting means for connecting said electric timer system detachably with said drug container.

7. The device of claim 1, wherein said electric pulse lead is integrated in said second foil.

8. The device of claim 1, wherein said electric pulse lead extends via several up to all of the blisters of the drug container.

9. The device of claim 1, wherein said drug container comprises blisters being filled with drug dose bodies of at least two types of drugs of different strength and different effective duration, and said electronic timer system comprises a corresponding number of at least two memory registers and the same corresponding number of starting pulse input means, and a corresponding electric pulse lead, each of said blisters being connected via a pulse lead with the corresponding pulse input means pertaining to the respective type of drug present in such blister.

10. The device of claim 9, wherein said timer system comprises a time-indicating means adapted for indicating the contents of that respective memory register which has been activated and recalled.

11. The device of claim 1, wherein said timer system comprises setting means for the input of register contents and a lockable cover for said setting means.

12. The device of claim 1, wherein said timer comprises setting means and setting pulse input means associated therewith, said setting pulse entry means being adapted for being shut off after programming.

13. The device of claim 1, wherein said electric pulse lead extends across said rupturable areas in an undulating configuration.

14. The device of claim 1, wherein said electric pulse lead extends across said rupturable areas in a zigzag configuration.

15. The device of claim 12, wherein said setting means comprise interruptable setting pulse leads, and said setting pulse input means are adaptable for being activated via said last-mentioned leads, said last-mentioned leads being applied on said second foil of said drug container so as to correspond with said electric pulse leads.

16. The device of claim 9, wherein said timer system comprises first setting pulse input means adapted for the input of a first drug dose consumption time, and second setting pulse input means adapted for the input of the time period for a consumption cycle.

17. The device of claim 12, wherein said setting pulse input means are in a pre-determined arrangement, and said timer system further comprises a perforated template adapted for being placed on said second foil in a preset, position marked thereon, said template being adapted for covering said arrangement of setting pulse input means in such a manner that, when said template is in said preset position on said second foil, only those setting pulse input means which are destined to be ruptured, are uncovered because they register with a perforation of said template and can thus be ruptured individually.

18. The device of claim 12, wherein said timer system comprises a programming punch and perforating pins protruding from one face of said punch, said perforating pins being disposed in a pin arrangement corresponding to the location of certain pre-selected setting pulse input means in said predetermined input means arrangement, said punch thus being adapted for simultaneously rupturing said certain setting pulse input means.

19. The device of claim 1, wherein said timer system comprises as a building unit, an integrated electrical circuit and an electronic sensor circuit, said sensor circuit being connected with said electric pulse leads on the input side.

20. The device of claim 19, wherein said sensor circuit is adapted for acting as a differentiator.

21. The device of claim 20, wherein said sensor circuit comprises, for each electric pulse lead present, two flip-flops connected in series and constituting a two-bit shifting register, and two exclusive-OR gates, each of said gates being connected on the output side to a different one of said flip-flops, the output of each gate being connected with a starting pulse input means of said integrated electrical circuit.

22. The device of claim 1, wherein the states of the electric pulse leads are checked only during timely separated short call pulses, in order to save electric energy.

23. The device of claim 22, wherein said timer system comprises first setting pulse input means, and calling of the electric pulse leads takes place after the activation of at least one of the first setting pulse input means.

24. The device of claim 1, wherein said timer system comprises a common starting pulse lead, as well as, connected in parallel with each section of an electric pulse lead extending across a blister pocket, a separate resistor, and an analogdigital converter type circuit adapted for determining the changes in total resistance, said converter type circuit having an input to which said common starting pulse lead is connected.

25. The device of claim 24, wherein each resistor is deposited on said second foil by the thick layer depositing method.

26. The device of claim 24, wherein each of said resistors has a different resistance value, and the dispensing interval period depends on the amount of resistance increase occurring when the corresponding electric pulse lead suction, connected with the respective resistor is ruptured.

27. The device of claim 1, wherein said timer system comprises a plurality of starting pulse inputs adapted for being recalled by at least one analog/digital converter, and, connected with each of the starting pulse inputs, a resistor chain, each of said starting pulse inputs also being connected with a section of said electric pulse lead extending across a blister pocket.

28. The device of claim 9, wherein said timer system comprises an integrated electric circuit and a second signal emitter connected with the output side of said integrated electric circuit.

29. The device of claim 28, wherein said second signal emitter is adapted for emitting optical signals.

30. The device of claim 1, wherein said signal emitter comprises a piezoelectric loudspeaker, adapted for emitting differently modulated sound signals.

31. The device of claim 1, wherein said signal emitter comprises a piezoelectric loudspeaker, adapted for emitting sounds of different frequencies.

32. The device of claim 1, wherein said timer system comprises an additional optical indicating means adapted for being activated automatically after a preselected period of time, whenever, after activation of the signal emitter, no drug dose body has been dispensed from the drug container.

33. The device of claim 1, wherein said timer system comprises an additional optical indicating means connected in series at the outlet side of said signal emitter and being automatically activatable whenever the signal emitter is activated after a periodically re-occurring period of time.

* * * * *